US005967002A

United States Patent [19]

Pijanowski

[11] Patent Number: 5,967,002

[45] Date of Patent: Oct. 19, 1999

[54] RACHET WRENCH

[76] Inventor: Joseph A. Pijanowski, 14351 Irving St., Brooksville, Fla. 34609

[21] Appl. No.: 08/951,625

[22] Filed: Oct. 16, 1997

[51] Int. Cl.[6] ..... B25B 13/46

[52] U.S. Cl. ..... 81/57.39; 81/63; 81/438

[58] Field of Search ..... 81/57.39, 121.1, 81/124.3, 124.4, 124.6, 124.7, 177.85, 438, 439, 63

[56] References Cited

U.S. PATENT DOCUMENTS

| | | | |
|---|---|---|---|
| 3,151,512 | 10/1964 | Charczenko | 81/438 X |
| 3,344,518 | 10/1967 | Roth | 81/438 X |
| 3,786,698 | 1/1974 | Diehl et al. | 81/57.39 |
| 3,941,017 | 3/1976 | Lenker et al. | 81/57.39 |
| 4,346,630 | 8/1982 | Hanson | 81/57.39 X |
| 4,372,181 | 2/1983 | Tinsley | 81/57.39 |
| 4,646,594 | 3/1987 | Tien | 81/121.1 |
| 4,722,252 | 2/1988 | Fulcher et al. | 81/57.39 |
| 4,987,802 | 1/1991 | Chern | 81/57.39 |
| 4,993,288 | 2/1991 | Anderson et al. | 81/57.39 |

*Primary Examiner*—James G. Smith
*Attorney, Agent, or Firm*—Michael J. Colitz, III

[57] ABSTRACT

The present invention relates to an air driven and manual rachet wrench. The wrench of the present invention includes a rotor which is rotated by way of an oscillatory member. The oscillatory member, in turn, is driven by way of an air powered drive assembly. A star shaped aperture is centrally formed within the rotor. This aperture is adapted to accept the stems of a variety of sockets. Although the rotor only rotates in one sense, the sockets can be inserted into either of the opposing faces of the rotor. Thus, through changing the face into which the socket is inserted, both clockwise and anti-clockwise socket rotation can be achieved.

6 Claims, 5 Drawing Sheets

RACHET WRENCH

BACKGROUND OF THE INVENTION

1. Field of the Invention

The present invention relates to a rachet wrench and more particularly pertains to a rachet wrench which can hold a variety of different sockets in one of two orientations.

2. Description of the Prior Art

The use of a rachet wrenches is known in the prior art. More specifically, ratchets wrenches are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,174,176 to Krivec discloses a reversible rachet wrench with an integrated dual pawl. This wrench includes a drive lug onto which a socket is attached. U.S. Pat. No. 4,993,288 to Anderson discloses a power driven rachet wrench with an associated reciprocal pawl. U.S. Pat. No. 4,722,252 to Fulcher discloses a power driven wrench with a drive stud which accepts conventional sockets. U.S. Pat. No. 4,475,420 to Atkinson discloses a wrench apparatus with an engaging end designed to engage a conventional socket. U.S. Pat. No. 4,372,181 to Tinsley illustrates a compact power wrenching machine. U.S. Pat. No. 4,346,630 to Hanson discloses a rachet wrench with a square item adapted to have a socket fitted thereon. U.S. Pat. No. 4,308,768 to Wagner discloses a ratchet lever with an interchangeable locking ring. U.S. Pat. No. 3,732,756 to Thomasian discloses a ratchet wrench with a socket facing each of its sides. U.S. Pat. No. 3,621,738 to Northcutt discloses a powered ratchet wrench with an associated socket wrench engaging stud. U.S. Pat. No. 3,529,498 to Northcutt discloses a power wrench with an associated stud. U.S. Pat. No. 3,145,594 to Peters discloses a ratchet wrench with a socket projection. U.S. Pat. No. 2,978,081 to Lundin discloses a drive assembly with an associated engaging end. Additionally, U.S. Design Pat. No. 289,135 to Doman and U.S. Design Pat. No. 269,938 to Izumisawa each disclose wrench designs.

Thus, the majority of prior art wrenches include socket engaging studs for cooperation with female socket tools. Additionally, the prior art wrenches employ reciprocal pawls.

In this respect, the rachet wrench of the present invention substantially departs from the conventional concepts and designs of the prior art. Specifically, the ratchet wrench of the present invention includes a rotor and associated aperture which function to lockingly engage a male socket stem. Additionally, the socket can be driven in a clockwise sense by positioning the socket in a first rotor face, and in an anti-clockwise sense by inserting the socket in the opposing rotor face. Thus, the need for pivotal pawls, spring tension on reverse handle, reverse levers or other such gearing means, is eliminated.

SUMMARY OF THE INVENTION

In view of the foregoing disadvantages inherent in the known types of rachet wrenches now present in the prior art, the present invention provides an improved drive means for a rachet wrench. As such, the general purpose of the present invention, which will be described subsequently in greater detail, is to enable clockwise or anti-clockwise socket rotation via a simplified socket drive.

To attain this, the present invention includes a rotor which is rotated by way of an oscillatory member. The oscillatory member, in turn, is driven by way of an air powered drive assembly. A star shaped aperture is centrally formed within the rotor. This aperture is adapted to accept the stems of a variety of sockets. Although the rotor only rotates in one sense, the sockets can be inserted into either of the opposing faces of the rotor. Thus, through changing the face into which the socket is inserted, either clockwise and anti-clockwise socket rotation can be achieved.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining the primary embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air driven rachet wrench in either ¼", ⅜", ½" sizes or metric equivalents thereof. The wrench is adapted to accept a variety of sockets. The wrench includes a housing which is defined by a lower threaded extent and an upper bifurcated extent. The upper bifurcated extent has an aperture formed therethrough. Additionally, an arcuate oscillatory member is included which also has a centrally located aperture. A plurality of teeth are formed along an internal periphery of this aperture. The oscillatory member is secured within the upper bifurcated extent of the housing. Air powered drive means are located within the lower extent of the housing and are interconnected with the oscillatory member. The drive means functions to oscillate the oscillatory member. The wrench also includes a rotor. This rotor is defined by an upper bifurcated extent, a lower extent, first and second halves. A star shaped six pointed aperture is formed through a central extent of the rotor. An aperture is formed within the lower extent of the rotor. The rotor is adapted to be secured within aperture of the oscillatory member. A rachet pawl is incorporated into the rotor. The pawl includes an engaging portion which is adapted to contact the internal periphery of the oscillatory member. Additionally, the rachet pawl is secured within the bifurcated extent of the rotor. A rachet pawl support pin and spring is angularly positioned within one side of the rotor and functions to support the engaging portion of the rachet pawl. Additionally, a spring biased socket support bearing, to secure socket preferences, is incorporated into the rotor. This bearing is defined by an upper extent and a lower extent. The socket support is adapted to be positioned within the aperture within the lower extent of the rotor. The upper extent of the support is adapted to engage a socket positioned within the central aperture of the rotor.

It is another object of the present invention to provide a rachet wrench that accepts male socket stems.

It is a further object of the present invention to provide a rachet wrench that can accept a socket into either of two opposing rotor faces and thereby achieve either clockwise or anti-clockwise rotation.

An additional object of the invention is to provide a super low profile rachet wrench for removing screws in automobile wheel opening moldings without having to spend time removing the corresponding tire.

An even further object of the present invention is to provide a rachet wrench which is susceptible of a low cost of manufacture with regard to both materials and labor, and which accordingly is then susceptible of low prices of sale to the consuming public, thereby making such ratchet wrench economically available to the buying public.

Still another object of the present invention is to provide a rachet wrench that, through the use of a star shaped aperture, can accept four and six sided socket stems. Additionally, it is an object of the present invention to enable the wrench to drive self taping sheet metal screws, nuts, or six sided screws.

Lastly, it is an object of the present invention to provide a rachet wrench of simplified construction and decreased profile.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

The present invention relates to an air driven rachet wrench. The wrench of the present invention includes a rotor which is rotated by way of an oscillatory member. The oscillatory member, in turn, is driven by way of an air powered drive assembly. A star shaped aperture is centrally formed within the rotor. This aperture is adapted to accept the stems of a variety of sockets. Although the rotor only rotates in one sense, the sockets can be inserted into either of the opposing faces of the rotor. Thus, through changing the face into which the socket is inserted, either clockwise and anti-clockwise socket rotation can be achieved. The various components of the present invention, and the manner in which they interrelate, will be described in greater detail hereinafter.

Figure 1:
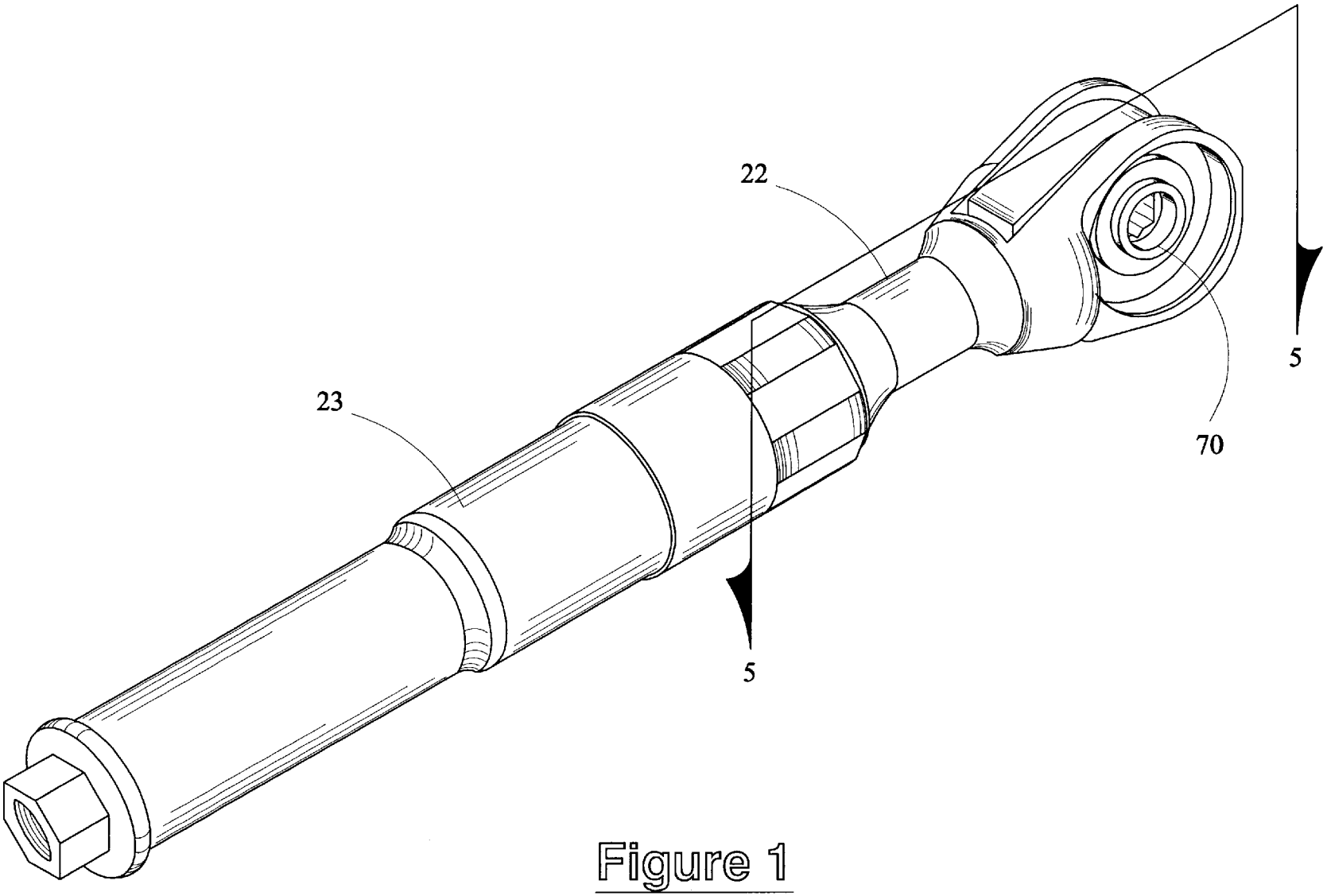
FIG. 1 a perspective view of the rachet wrench of the present invention.

With reference to FIG. 1, the ratchet wrench 20 of the present invention is depicted. The wrench 20 generally includes a housing portion 22 and a handle portion 23. The housing 22 includes a lower threaded extent 24 and an upper bifurcated extent 26. The bifurcated extent 26 is formed by an oblong aperture positioned within the housing portion 22. Additionally, the upper bifurcated extent 26 includes a centrally located aperture 28.

An arcuate oscillatory member 32 is specifically adapted to be secured within the bifurcated extent 26 of the housing 22. The oscillatory member 32 is defined by a centrally located aperture 34. Additionally, a plurality of teeth 36 are formed along the internal periphery of the aperture 34. The securement between member 32 and housing 22 is such that the oscillatory member 32 is permitted limited pivotally movement about the central axis of the bifurcated extent 28. Additionally, the oscillatory member 32 includes a concave recess formed at its lower extent. This recess allows the member to be interconnected with the driving means 38 of the wrench. This interconnection will be described in greater detail hereinafter.

Figure 2:
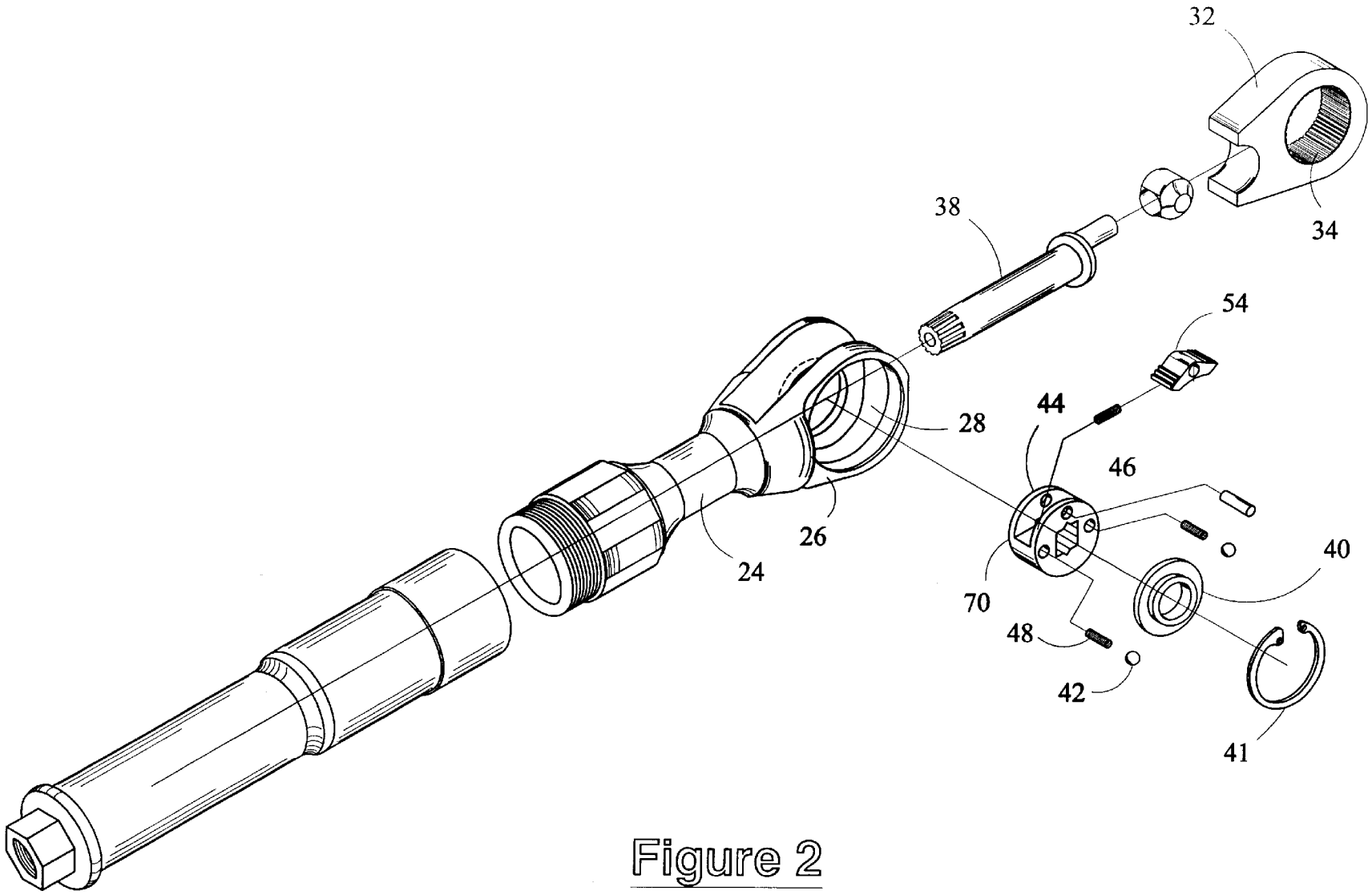
FIG. 2 is an exploded view of the rachet wrench of the present invention.

As indicated hereinabove, the wrench 20 of the present invention is adapted to be driven by a source of pressurized air. Other driving means, however, are within the scope of the present invention. The air powered drive means 38 of the present invention is located within the lower extent 24 of the housing 22 and extends into the handle 23 of the wrench 20. More specifically, the drive means 38 includes a drive column which is positioned through the housing 22 and handle 23. The column is rotated by a gearing assembly (not shown). The gearing assembly, in turn, is powered by the source of compressed air. With reference to FIG. 2, a drive bushing is adapted to be positioned at the top of the drive column. The drive bushing is shaped to be received within the concave recess of the oscillatory member 32. Thus, rotation of the drive column results in the side to side movement of the drive bushing. The movement of the bushing, in turn, causes the angular oscillation of the member 32. In this manner, the drive means 38 is interconnected with the oscillatory member 32 and functions to oscillate the oscillatory member 32.

Figure 3:
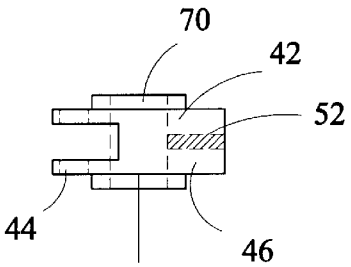
FIG. 3 is a side elevational view of the rotor of the present invention.
Figure 4:
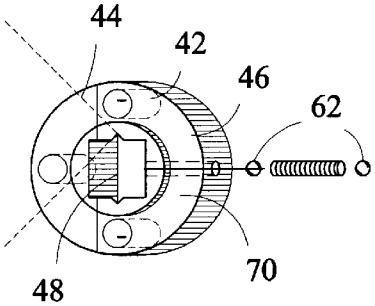
FIG. 4 is a plan view of the rotor of the present invention.

With reference to FIGS. 3 and 4, the rotor 42 of the present invention is depicted. The rotor 42 is secured within the aperture 34 of the oscillatory member 32. The securement is achieved by way of locking ring securement. One such assembly is depicted in FIG. 2. As illustrated, retaining washer 40 and lock ring 41 serve to hold rotor 42 once in the oscillatory housing 32. The securement also employs two ball bearings and springs 58, only one of which is shown for clarity. The two ball bearings and springs in the rotor apply pressure on the washer to preclude the rotor from slipping. These ball bearings and springs 58 provide pressure between the rotor 42, retaining washer 40, lock ring 41 and housing 22 once the oscillatory member 32 is positioned within the housing 22. Such an arrangement prevents any slippage within the housing 26 when member 32 is oscillating. The rotor 42, which is of a one piece construction, is defined by an upper bifurcated extent 44, a lower extent 46, and first and second halves. Additionally, a star shaped six pointed aperture 48 is formed through a central extent of the rotor 42. This aperture 48 is employed in securing socket stems 50 to the rotor 42.

In the preferred embodiment, as can be seen in FIG. 3, the height of the rotor 42 is about 0.75 inches. This height enables the rachet to be employed upon sheet metal screws. With a Phillips head socket inserted, there would be a height of 1.25 inches. This would be the smallest tolerance ever utilized rendering it adapted for use in many tight applications.

Figure 7:
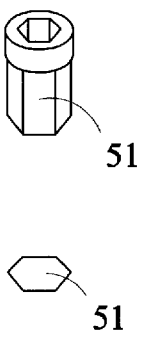
FIG. 7 is a view of a socket with a six sided stem for use within the wrench of the present invention.
Figure 6:
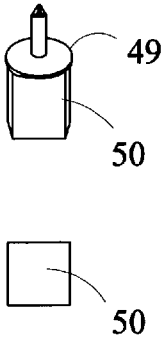
FIG. 6 is a view of a socket with a four sided stem for use within the wrench of the present invention.
Figure 9:
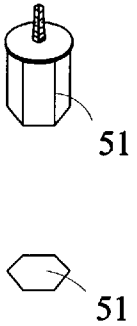
FIG. 9 is a view of a socket with a six sided stem.

With reference to FIGS. 6 and 7, two such sockets and their associated stems 50 and 51 are depicted. The six pointed star shaped geometry of the aperture 48 enables it to accept either four or six sided stems 50 and 51 respectively. A four sided stem 50 is illustrated in FIG. 6. A six sided stem 51 is illustrated in FIGS. 7 and 9. FIG. 6 illustrates a stem 50 and associated collar 49. The stem 51 of FIG. 9 is of a short ⅛" or ¾" drill height which is adapted to be used in a wheel opening for molding installations. These sockets, when used in conjunction with stems 50 and 51, of various sizes, will speed time for a variety of mechanical installations. Any one of the sockets of FIGS. 6, 7 and 9 can be secured with the rotor 42 aperture by way of a socket bearing 62. The bearing 62 is positioned within an aperture 52 formed within the lower extent 46 of the rotor 42. This socket bearing 62, and its position within the rotor 42, will be described in greater detail hereinafter.

The rotor 42 employs a rachet pawl 54 which functions to contact the teeth 36 of the internal surface of the oscillatory member 32. The rachet pawl 54, and its position within the rotor 42, is depicted in the cross section of FIG. 5. As illustrated, the rachet pawl 54 is secured within the bifurcated extent 44 of the rotor 42. More specifically, a pin 57 is employed in securing the pawl 54 to aligned apertures within the bifurcated extent 44 of rotor 42.

Figure 5:
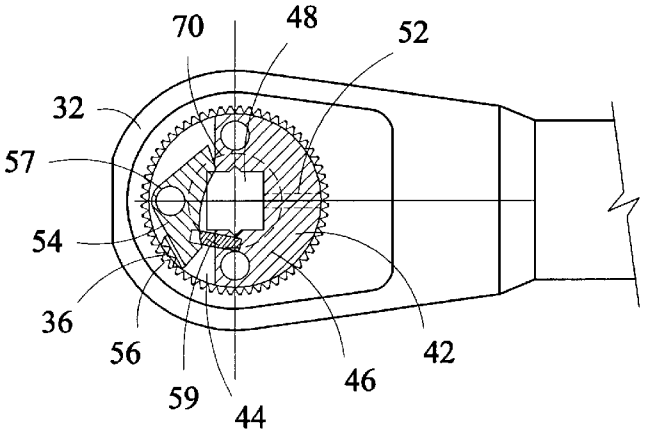
FIG. 5 is view taken along line 5—5 of FIG. 1.

With continuing reference to FIG. 5, the pawl 54 includes an engaging portion 56. This engaging portion 56 includes a series of teeth which are adapted to engage the teeth 36 on the internal periphery of the oscillatory member 32. Through this engagement, the oscillating angular movement of the member 32, pressure washer 40 and locking ring 41 serves to rotate the rotor 42. A rachet pawl support pin 59 is angularly positioned within one side of the rotor 42. More specifically, the support pin 59 is angularly related to the longitudinal axis of the wrench 20. This pin 59 functions to support the engaging portion 56 of the rachet pawl 54. Thus, the support pin 59 and spring ensure that the teeth of engaging portion 56 maintain positive contact with the teeth 36 of the oscillatory member 32.

Figure 8:
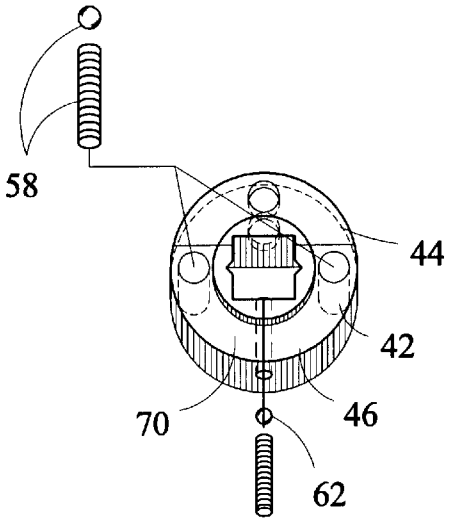
FIG. 8 is an exploded view of the rotor of the present invention.

A locking engagement between the rotor 42 and associated socket stem 51 is achieved by way of a socket bearing 62. The bearing 62 is defined by an upper and lower extent. As illustrated in FIG. 8, the socket bearing 62 is adapted to be positioned within the aperture 52 within the lower extent 46 of the rotor 42. When so positioned, the upper extent of the support can engage socket stem 50 positioned within the central aperture 48 of the rotor 42. Socket stem 50 includes a collar 49. With socket stem 50, a locking engagement is achieved when collar 49 engages the periphery of aperture 48. The collar 49 prevents the socket from sliding into the aperture 48 when pressure is applied to the socket. In the preferred embodiment, the socket stems 50, 51 include surface indentations for lockingly engaging the bearing 62 to secure socket stems and prevent them from slipping out.

Thus, the rotor aperture 52 and associated support bearing 62 are adapted to accept a socket stem 50, 51, or 52 from either side of the rotor. The rotor, however, only rotates in one sense/direction. Specifically, the angular oscillatory movement of member 32 drives the rotor 42 only in one direction due to the positioning of pawl 54. Yet, because the socket stem can be positioned into either side of the rotor, both clockwise and anti-clockwise socket rotation can be achieved.

The rotor 42 also includes an associated rotor collar 70. This collar 70 enables the rachet wrench to drive self tapping sheet metal screw. Additionally, this collar 70 would enable the wrench to drive nuts.

Figure 12:
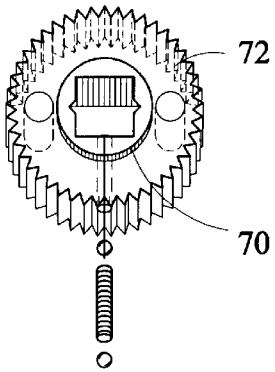
FIG. 12 is a view of an additional rotational member that can be employed in the second embodiment of the present invention.
Figure 11:
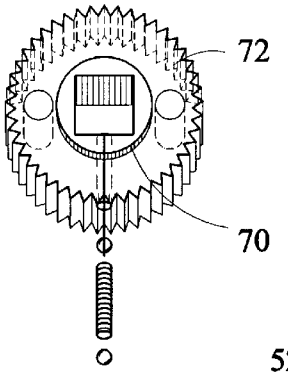
FIG. 11 is a view of the rotational member of the second embodiment.
Figure 10:
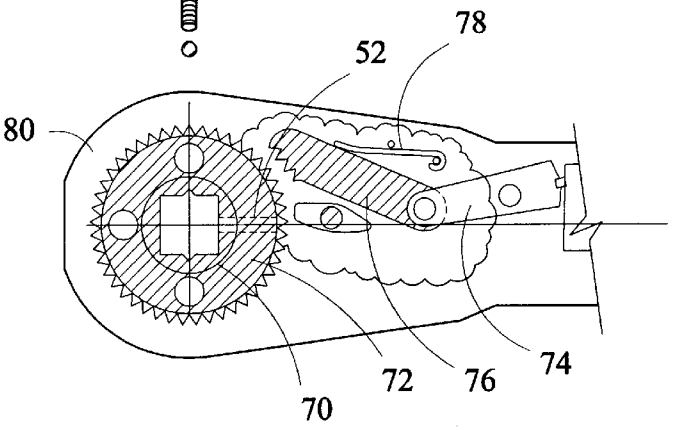
FIG. 10 is a view of the second embodiment of the present invention.

With reference to FIGS. 10–12, a second embodiment of the wrench is illustrated. This second embodiment utilizes a single geared rotational member 72 in place of oscillatory member 32 and rotor 42. The rotational member is positioned within the upper portion of housing 80. As with the primary embodiment, the upper portion of the housing 80 has an aperture formed therethrough. The rotational member 72 can employ either a centrally located square (FIG. 11) or star shaped (FIG. 12) aperture. As with the primary embodiment, these apertures are adapted to accept socket stems. The rotational member 72 is rotated via a two arm linkage: a base arm 74 and a pawl 76. The base arm 74 and pawl 76 are pivotally interconnected. The base arm 74 converts the rotational motion of the drive means into oscillatory motion. The base arm 74 transmits this oscillatory motion to the pawl 76.

The pawl 76 has a series of teeth which are adapted to engage the geared outer periphery of the rotational member 72. Through this engagement, the pawl 76 rotates the rotational member 72. Thus, the drive means is interconnected to the rotational member. A leaf spring 78 is positioned adjacent to the pawl 76. The leaf spring 78 functions to keep the pawl engaged with the periphery of the rotational member 72. As with the primary embodiment, the sockets can be rotated in differing directions by inserting the socket stems into either of the faces of the rotational member 72.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air driven rachet wrench adapted to accept a variety of sockets, the wrench comprising in combination:

a housing having a lower threaded extent and an upper bifurcated extent, the upper bifurcated extent having an aperture formed therethrough;

an arcuate oscillatory member having a centrally located aperture, a plurality of teeth formed along an internal periphery of the aperture, the oscillatory member secured within the upper bifurcated extent of the housing;

air powered drive means located within the lower extent of the housing interconnected with the oscillatory member and functioning to oscillate the oscillatory member;

a rotor having an upper bifurcated extent, a lower extent, first and second halves, a multi-sided aperture formed through a central extent of the rotor, an aperture formed within the lower extent, the rotor secured within the centrally located aperture of the oscillatory member;

a rachet pawl having an engaging portion adapted to contact the internal periphery of the oscillatory member, the rachet pawl secured within the bifurcated extent of the rotor, a rachet pawl support pin angularly positioned within one side of the rotor and functioning to support the engaging portion of the rachet pawl;

a spring biased socket support bearing having an upper extent and a lower extent, the socket support bearing adapted to be positioned within the aperture within the lower extent of the rotor, the upper extent of the support bearing adapted to engage a socket positioned within the central aperture of the rotor.

2. A rachet wrench adapted to accept a variety of sockets, the wrench comprising, in combination:

a housing having a lower extent and an upper bifurcated extent, the upper bifurcated extent having an aperture formed therethrough;

an oscillatory member having a centrally located aperture, a plurality of teeth formed along an internal periphery of the aperture, the oscillatory member secured within the upper bifurcated extent of the housing;

drive means located within the lower extent of the housing interconnected with the oscillatory member and functioning to oscillate the oscillatory member;

a rotor having an upper bifurcated extent, a lower extent, first and second halves, an aperture formed through a central extent of the rotor, the rotor secured within the aperture of the oscillatory member;

a rachet pawl having an engaging portion on one side only adapted to contact the internal periphery of the oscillatory member, the rachet pawl secured within the bifurcated extent of the rotor.

3. The rachet wrench as described in claim 2 wherein:

the aperture of the rotor is star shaped and has six points such that the aperture can accept both four sided and six sided sockets.

4. The rachet wrench as described in claim 2 wherein:

the aperture of the rotor is square shaped.

5. The rachet wrench as described in claim 2 further comprising:

an aperture formed within the lower extent of the rotor; and a spring biased socket support bearing having an upper extent and a lower extent, the socket support bearing adapted to be positioned within the aperture within the lower extent of the rotor, the upper extent of the support bearing adapted to engage a socket positioned within the central aperture of the rotor.

6. The rachet wrench as described in claim 2 further comprising:

a rachet pawl support pin and spring angularly positioned within one side of the rotor and functioning to support the engaging portion of the rachet pawl.

* * * * *